US005920910A

United States Patent [19]

Calvo

[11] Patent Number: 5,920,910

[45] Date of Patent: Jul. 13, 1999

[54] SWEATBAND FOR SPORTS CAP

[76] Inventor: Peter A. Calvo, 2919 NW. 5th Ave., Wilton Manors, Fla. 33311

[21] Appl. No.: 08/897,234

[22] Filed: Jun. 18, 1997

Related U.S. Application Data

[60] Provisional application No. 60/020,828, Jun. 21, 1996.

[51] Int. Cl.[6] ..... A42C 5/02

[52] U.S. Cl. ..... 2/181.4; 2/181; 2/DIG. 11

[58] Field of Search ..... 2/181, 181.2, 181.4, 2/DIG. 11

[56] References Cited

U.S. PATENT DOCUMENTS

| | | | |
|---|---|---|---|
| 1,155,936 | 10/1915 | Kremer . | |
| 1,571,827 | 2/1926 | Wharton . | |
| 2,106,075 | 1/1938 | Tabley | 2/181 |
| 2,445,209 | 7/1948 | Clark . | |
| 3,906,548 | 9/1975 | Kallis . | |
| 4,468,817 | 9/1984 | Nunnery et al. . | |
| 4,551,859 | 11/1985 | Gerhardt | 2/181 |
| 5,327,585 | 7/1994 | Karlan . | |
| 5,428,844 | 7/1995 | Dougherty . | |

FOREIGN PATENT DOCUMENTS

| | | |
|---|---|---|
| 104432 | 7/1938 | Australia . |
| 454444 | 2/1949 | Canada . |

*Primary Examiner*—Diana L. Biefeld
*Attorney, Agent, or Firm*—Richard C. Litman

[57] ABSTRACT

A sweatband for use with a sports cap of the type having a crown portion with a lower margin and an inner band secured to the lower margin of the crown portion to form a channel extending about the interior of the crown portion. The sweatband has first and second portions connected together along a top edge of the sweatband. The first portion is preferably a multilaminate structure including a layer of absorbent material permanently secured to a first layer of water resistant material. The second portion is a second layer of water resistant material secured to the first layer of water resistant material at the top edge of the sweatband, thereby allowing the lower edges of the first portion and second portion to remain free. The second portion of the sweatband is removably inserted into the channel between the inner band and the crown portion of the sports cap such that the first portion lies intermediate the inner band and a wearer's head, and the second portion lies intermediate the inner band and the crown portion. The first layer of water resistant material limits the amount of moisture and oils which may collect in the inner band of the cap, and the second layer of water resistant material minimizes contact between the inner band and the crown of the cap.

12 Claims, 2 Drawing Sheets

SWEATBAND FOR SPORTS CAP

CROSS REFERENCE TO RELATED APPLICATIONS

This application claim the benefit of U.S. Provisional application Ser. No. 60/020,828 filed Jun. 21, 1996.

BACKGROUND OF THE INVENTION

1. Field of the Invention

The present invention generally relates to headgear and, more specifically, to a sweatband that is removably inserted and retained on the inside surface of headgear such as a sports cap.

2. Description of Related Art

Headgear of all types (i.e., athletic, casual, etc.) typically limit the amount of body heat lost through the scalp. As a result, the wearing of headgear usually prompts an increase in perspiration. To avoid discomfort and the possibility of damaging such headgear (particularly casual headgear) with perspiration stains, it is desirable to utilize an absorbent member in conjunction with such headgear. While the related art discloses numerous inventions relating to sweatbands for headgear, none utilize the inner rim of a piece of headgear in the same manner as the present invention, which can be easily installed over such a rim to absorb moisture from the wearer's forehead and just as easily removed for its cleaning and/or replacement.

U.S. Pat. No. 1,155,936, issued on Oct. 5, 1915, to Harry D. Kremer, discloses a sweatband covered with hair which is intended to be adhesively secured inside a hat. The sweatband functions as a cushion to the head, allowing blood circulation within effected portions of the scalp.

U.S. Pat. No. 1,571,827, issued on Feb. 2, 1926, to Frederick Wharton, discloses a sweatband for hats. The sweatband includes notches formed on the sweatband such that it may be sewn or otherwise secured within a hat for alignment of the notches with a wearer's temples.

U.S. Pat. No. 2,445,209, issued on Jul. 13, 1948, to Edward S. Clark, discloses an absorptive headwear pad for spacing about the inside of a hat. The pads include a moisture impervious envelope, a backing material contained within the envelope, and a pad element connected to the backing material and extending through an opening in the envelope. The pads are secured to the sweatband of a hat to space the hat from the wearer's head for allowing ventilation of the scalp. The pads are disposed to conduct sweat and oils to the backing material where they are contained within the envelope to prevent damage to the head wear.

U.S. Pat. No. 3,906,548, issued on Sep. 23, 1975, to Bert J. Kallis, discloses a sweatband for a hard hat suspension unit. The sweatband is a one-piece form with extensions present along one edge of the form and a plurality of tabs present along the opposite edge of the unit. Upon folding of the tabs and extensions around a band of the suspension unit, mating fasteners on the tabs and extensions secure the form to the unit.

U.S. Pat. No. 4,468,817, issued on Sep. 4, 1984, to Merle W. Nunnery and Judith Noel, discloses a terry-cloth perspiration band for headgear which is attached to a hatband with male and female snap fasteners.

U.S. Pat. No. 5,327,585, issued on Jul. 12, 1994, to Edward J. Karlan, discloses a cap which includes headband forming a channel along the lower inner periphery of the cap and a tubular body removably anchored within the channel by mating hook and loop fasteners. The tubular body is segmented into a plurality of fluid compartments and it has a heat reflective and water impervious outer panel secured to one side thereof.

U.S. Pat. No. 5,428,844, issued on Jul. 4, 1995, to Gary L. Dougherty, discloses a sweatband attachable to a headband of a hat. The sweatband is divided into three panels and it may be C-folded or otherwise wrapped around the headband of the hat such that hook and loop fasteners of overlapping panels confront one another to secure the sweatband. The sweatband may also include an advertising message on an exposed panel thereof.

Australian Patent No. 104,432, dated Jul. 14, 1938, to Edward Crocker Sloan and Gustave A. Spoore, discloses a sweatband which is retained inside a hat by a plurality of straps.

Canadian Patent No. 454,444, issued Feb. 8, 1949, to John J. Cartledge, discloses a hat having a headband and a thermoplastic strip bonded to the hat and the headband intermediate the same.

None of the above inventions and patents, taken either singly or in combination, is seen to describe the instant invention as claimed. Specifically, none of the prior art discloses a sweatband which is made of an absorbent material and removably inserted within the channel of a headband such that the absorbent material of the sweatband is disposed for contacting a wearer's head.

SUMMARY OF THE INVENTION

The present invention is intended for use in combination with a sports cap of the type having a crown portion with a lower margin and an inner band secured to the lower margin of the crown portion to form a channel extending about the interior of the crown portion. The sweatband generally comprises a first portion and a second portion which are connected together along a top edge of the sweatband. The first portion is preferably a multilaminate structure including a layer of absorbent material such as cotton terry cloth, and a first layer of water resistant material such as vinyl. The first layer of water resistant material is permanently secured to the layer of absorbent material. The second portion is formed of a second layer of water resistant material such as vinyl. The second layer of water resistant material is secured to the first layer of water resistant material at the top edge of the sweatband, thereby allowing the lower edges of the first portion and second portion to remain free.

The second portion of the sweatband is adapted to be removably inserted into the channel between the inner band and the crown portion of the sports cap such that the first portion lies intermediate the inner band and a wearer's head, and the second portion lies intermediate the inner band and the crown portion. This allows the sweatband to absorb moisture and oils from the wearer's head while preventing the passage of moisture and oils to the sports cap. The first layer of water resistant material limits the amount of moisture and oils which may collect in the inner band of the cap, and the second layer of water resistant material minimizes contact between the inner band and the crown of the cap. Therefore, together the various layers of sweatband tend to minimize the amount of moisture and oil which can be absorbed by the inner band and the crown of the sports cap. When soiled, the sweatband may be removed for cleaning or replaced by a like sweatband.

Accordingly, it is a principal object of the invention to provide a sweatband that will make the user more comfortable.

It is another object of the invention to provide a means for preventing damage or discoloration to headgear from perspiration or other moisture.

It is a further object of the invention to provide a sweatband that can be easily inserted over the inner rim of a cap or hat.

Still another object of the invention is to provide a sweatband that can easily be removed from a cap or hat for cleaning.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
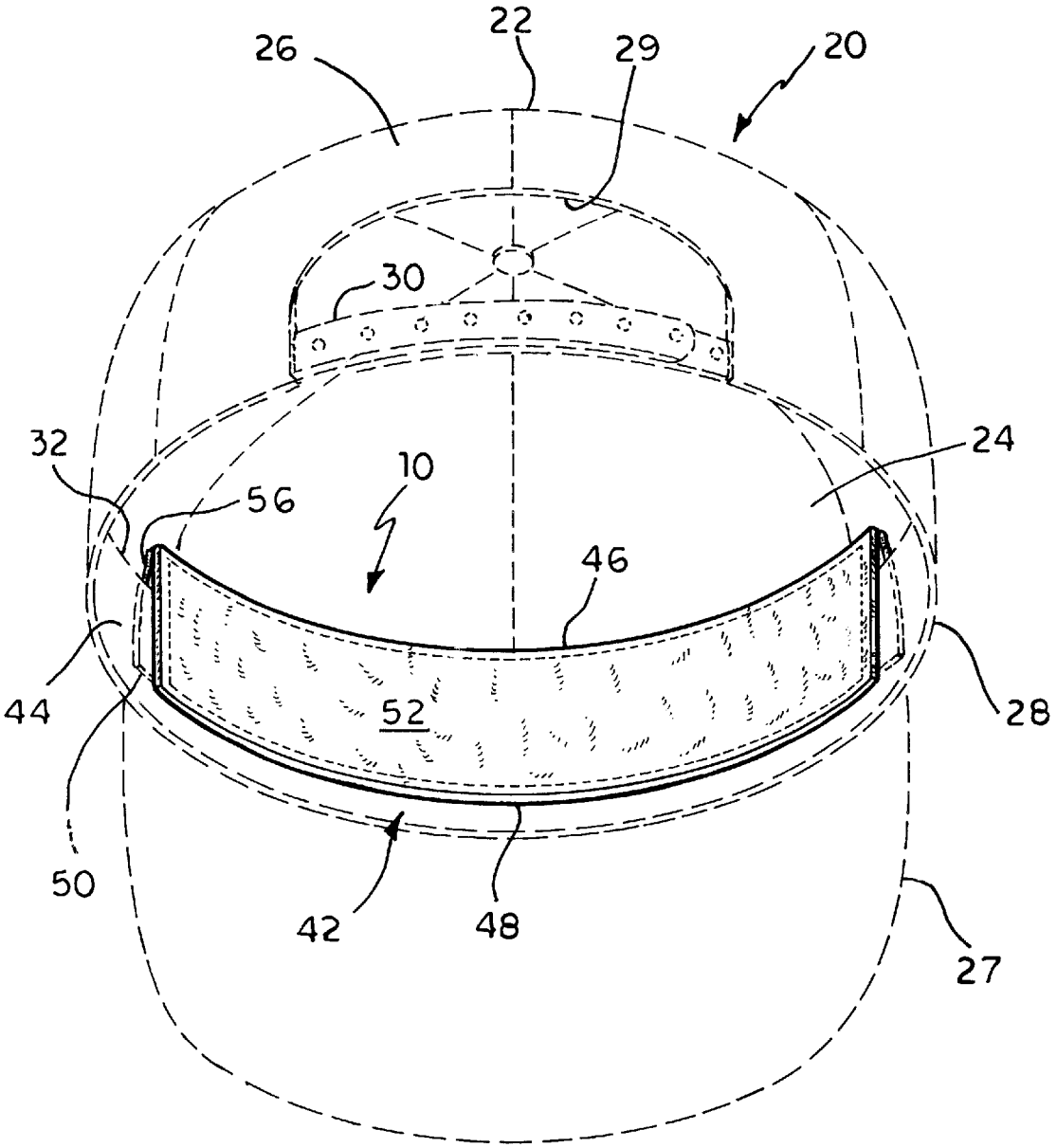
FIG. 1 is an environmental view of a sweatband of the present invention shown in combination with a sports cap.
Figure 2:
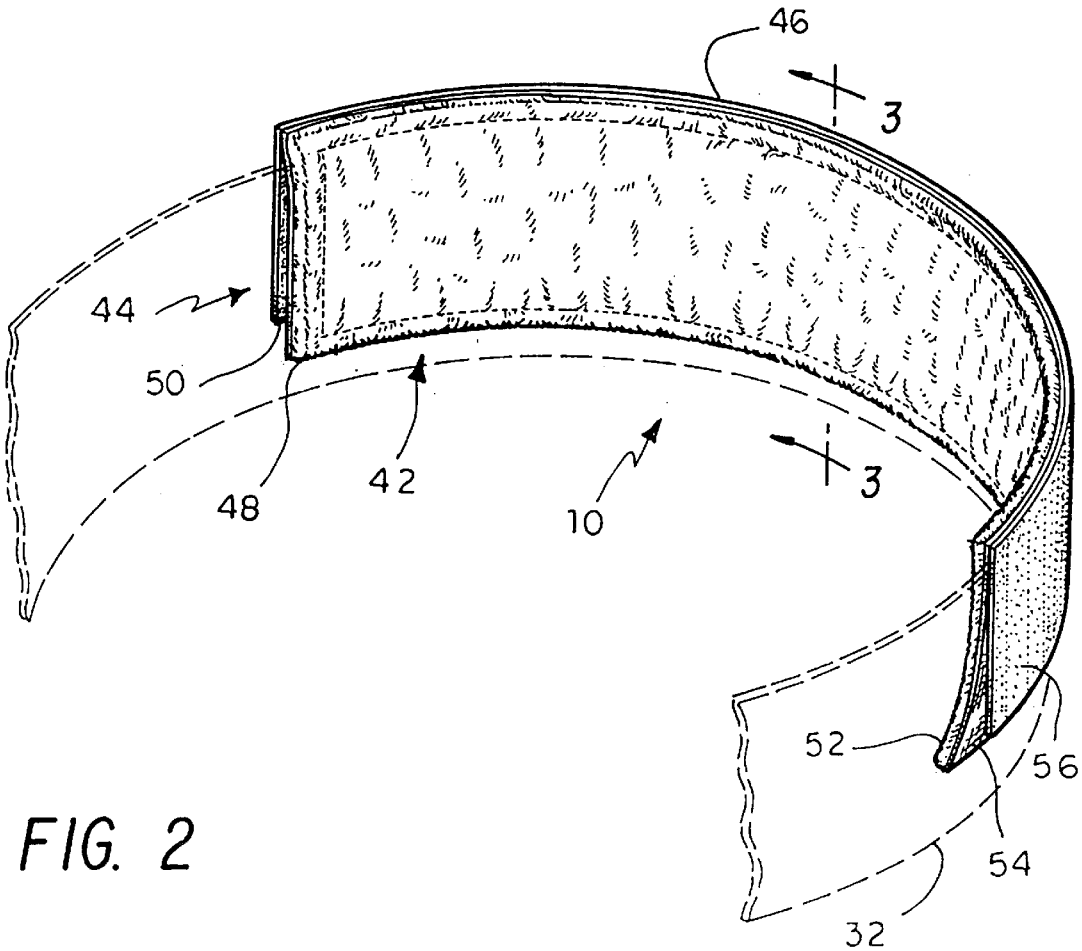
FIG. 2 is a perspective view of the invention showing in detail the relationship between first and second portions of the sweatband and an inner rim of the sports cap.

Referring now to the drawings by numerals of reference and first to FIGS. 1 and 2, a sweatband 10 of the present invention is shown used in combination with a sports cap 20 (i.e., baseball cap). Sports caps 20 typically include a downwardly opening crown 22 having front and rear sides 24 and 26, respectively. A bill 27 extends from the front side 24 at a lower margin 28 of the crown 22. At the rear side 26 is an opening 29 that is bridged by an adjustable strap 30 which is useful for adjusting the hat size to accommodate a broad range of head sizes. Formed along the interior of the crown 22 at the lower margin 28 thereof is an inner band 32 which extends continuously around the crown from opposite sides of the opening 29. The inner band 32 typically is sewn to the crown 22 at the lower margin thereof such that the inner band and crown together form a closed-bottom channel.

Figure 3:
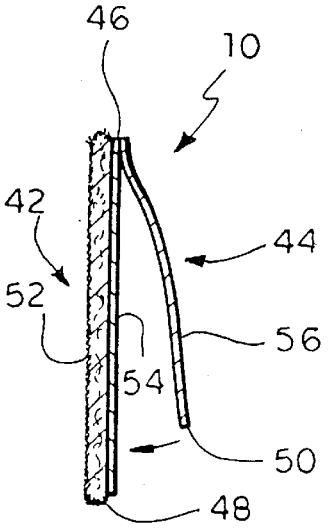
FIG. 3 is a cross-sectional view of the invention taken along line 3—3 of FIG. 2.
Figure 4:
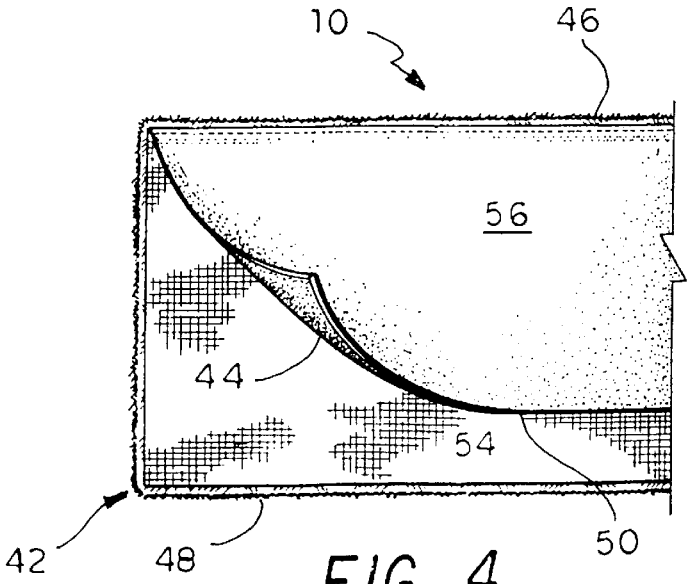
FIG. 4 is a partial elevational view of one end of the invention, shown from the side bearing the second portion of the sweatband.

Referring also now to FIGS. 3 and 4, the sweatband 10 generally comprises a first portion 42 and a second portion 44. The sweatband 10 is generally rectangular in shape, having a length at least as long as the brim 27, which renders the sweatband suitable for coverage of the forehead region of the wearer. The sweatband 10 may have a length equal to the length of the inner band 32, however, so that the sweatband would extend along the inner band 32 from one side of the opening 29 to the other side of the opening. The first and second portions 42 and 44 are permanently secured together along a top edge 46 of the sweatband 10, as discussed hereinafter. Thus, the first portion 42 has a free lower edge 48 and the second portion 44 has a free lower edge 50. This is illustrated in FIGS. 3 and 4, were the lower edge 50 of the second portion 44 is shown to be independent of and capable of being moved toward and away from the lower edge 48 of the first portion. It should be noted, however, that because the first and second portions 42 and 44 are secured together along the top edge 46 of the sweatband 10, the second portion 44 has a natural tendency to return to a position lying flat against the first portion 42 (as indicated by the arrow in FIG. 3). This allows the sweatband 10 to straddle the inner band 32 of the sports cap 20 with the first portion 42 being exposed to the head of the wearer and the second portion 44 being received within the channel.

It also is preferable that the first portion 42 have a larger width than the second portion 44. Thus, the second portion 44 has been shown in FIGS. 3 and 4 with a somewhat smaller width than the first portion 42 (i.e., the lower edge 50 of the second portion is displaced from the lower edge 48 of the first portion). The only functional requirement is that the second portion 44 not have a width which is wider than the width of the first portion 42. Therefore, it also is possible for the first and second portions 42 and 44 to have substantially the same dimensions.

The first portion 42 at a minimum includes a layer of absorbent material 52. Suitable absorbent materials include woven and non-woven fabrics having a sufficiently high pile and preferably formed of non-allergenic fibers. One example of a woven fabric having a sufficiently high pile is a cotton fabric commonly known as terry-cloth. It is preferable, however, for the first portion 42 to have a multilaminate construction, including the layer of absorbent material 52 secured to a first layer of water resistant material 54. Water resistant materials for use with the present invention are preferably durable yet flexible, allowing the first portion 42 to bend without causing permanent deformation of the sweatband 10. Suitable water resistant materials include vinyl plastics and plastics known in the art as template plastic. The layer of absorbent material 52 and the first layer of water resistant material 54 are permanently secured together by any conventional means, including but not limited to sewn stitching arid adhesives.

The second portion 44 at a minimum includes a second layer of water resistant material 56. Suitable water resistant materials for use with the second layer of water resistant material 56 include those described above with respect to the first layer of water resistant material 54. The first and second portions 42 and 44 are permanently secured by permanently securing together the first and second layers of water resistant material 54 and 56, respectively. In the event the first and second layers of water resistant material 54 and 56 are formed from the same material, then it is possible to permanently secure the two layers together by conventional heat sealing processes which fuse the layers. Alternatively, and regardless of the material used to form the layers, the first and second layers of water resistant material 54 and 56 may be sewn together by stitching along the entire top edge 46 of the sweatband 10.

The sweatband 10 is used in combination with a sports cap 20 by inserting the second portion 44 into the channel formed by the inner band 32 and the crown 22 of the cap. With the second portion 44 inserted into the channel, the first portion 42 lies intermediate the head of the wearer and the inner band 32. The amount of the coverage which the sweatband provides depends upon its length. Therefore, the sweatband 10 may only cover the forehead portion of the wearer, which is suggested by the length of the sweatband shown in FIG. 1. As discussed above, the sweatband 10 may extend about the entire length of the inner band 32, thereby covering a larger area of the wearer's head.

When properly positioned on the sports cap 20, the sweatband will absorb moisture and oils from the wearer's head while preventing the passage of moisture and oils to the sports cap itself. The first layer of water resistant material 54 limits the amount of moisture and oils which may collect in the inner band 32, and the second layer of water resistant material 56 minimizes contact between the inner band 32 and the crown 22 of the cap. Therefore, together the various layers of sweatband 10 will tend to minimize the amount of moisture and oil which can be absorbed by the inner band 32 and the crown 22 of the sports cap 20. This reduces the likelihood of soiling the sports cap 20, which is oftentimes difficult to wash. Furthermore, some sports caps may be fabricated out of materials which can be ruined by the presence of salt stains from evaporated perspiration. Thus, in some cases it may be best to avoid any soiling of the sports cap.

When the sweatband 10 becomes soiled or the user otherwise wishes to remove the sweatband from the sports cap 20, the user simply needs to grasp the sweatband 10 and pull the second portion thereof from the channel defined by the inner band 32 and crown 22. Because of the materials used to construct the sweatband 10, a user may either machine wash or hand wash the sweatband and reuse it once it has been cleaned. Alternatively, a user may wish to dispose of the sweatband 10 and replace it with a new one.

An alternative construction for a sweatband of the present invention (not shown) is to include a first portion in the form of a continuous loop which is secured at its top edge to a second portion having a length no longer than the length of the inner rim 32. Thus, as discussed with respect to the embodiment described above, the second portion would lie within the channel formed by the inner band 32 and the crown 22 of the sports cap 20, while the first portion would encircle the entire head of the wearer (i.e., spanning the opening 29).

It is to be understood that the present invention is not limited to the embodiments described above, but encompasses any and all embodiments within the scope of the following claims.

I claim:

1. A sweatband for use in a cap of the type having a crown portion with a lower margin and an inner band secured to the lower margin of the crown portion to form a channel extending about the interior of the crown portion, the sweatband comprising:

a first portion having a top edge and a lower edge, said first portion including a layer of absorbent material; and a second portion having a top edge and a lower edge, said second portion including a layer of water resistant, vinyl plastic material, and said top edge of said second portion being secured to said top edge of said first portion;

said second portion being adapted for insertion into the channel between the inner band and the crown portion of the cap such that said first portion lies intermediate the inner band and a wearer's head, and said second portion lies intermediate the inner band and the crown portion.

2. A sweatband according to claim 1, wherein said layer of absorbent material is selected from the group consisting of woven fabrics having a high pile and non-woven fabrics having a high pile.

3. A sweatband according to claim 2, wherein said layer of absorbent material is cotton terry cloth.

4. A sweatband according to claim 1, wherein said first portion is multilaminate, said first portion further including a layer of water resistant material, said first portion layer of water resistant material being secured to said layer of absorbent material; and said second portion is secured to said first portion with said second portion layer of water resistant material confronting said first portion layer of water resistant material.

5. A sweatband according to claim 4, wherein said first portion layer of water resistant material is made of vinyl plastics.

6. A sweatband for use in a cap of the type having a crown portion with a lower margin and an inner band secured to the lower margin of the crown portion to form a channel extending about the interior of the crown portion, the sweatband comprising:

a first portion having a top edge and a lower edge, said first portion being multilaminate, including a layer of absorbent material selected from the group consisting of woven fabrics having a high pile and non-woven fabrics having a high pile, and a first layer of water resistant, vinyl plastic material, said first layer of water resistant material being secured to said layer of absorbent material; and a second portion having a top edge and a lower edge, said second portion including a second layer of water resistant, vinyl plastic material, and said top edge of said second portion being secured to said top edge of said first portion with said second layer of water resistant material confronting said first layer of water resistant material;

said second portion being adapted for insertion into the channel between the inner band and the crown portion of the cap such that said first portion lies intermediate the inner band and a wearer's head, and said second portion lies intermediate the inner band and the crown portion.

7. In combination, a cap having a downwardly opening crown portion with a lower margin and an inner band secured to said lower margin of the crown portion to form a channel extending about the interior of the crown portion; and a sweatband comprising:

a first portion having a top edge and a lower edge, said first portion including a layer of absorbent material; and a second portion having a top edge and a lower edge, said second portion including a layer of water resistant material, and said top edge of said second portion being secured to said top edge of said first portion;

said sweatband second portion being inserted into said channel between said inner band and said crown portion of said cap such that said first portion lies intermediate said inner band and a wearer's head, and said second portion lies intermediate said inner band and said crown portion.

8. A sweatband according to claim 7, wherein said layer of absorbent material is selected from the group consisting of woven fabrics having a high pile and non-woven fabrics having a high pile.

9. A sweatband according to claim 8, wherein said layer of absorbent material is cotton terry cloth.

10. A sweatband according to claim 7, wherein said second portion layer of water resistant material is a vinyl plastic.

11. A sweatband according to claim 7, wherein said first portion is multilaminate, and said first portion further including a layer of water resistant material, said first portion layer of water resistant material being secured to said layer of absorbent material; and 2said second portion is secured to said first portion with said second portion layer of water resistant material confronting said first portion layer of water resistant material.

12. A sweatband according to claim 11, wherein said first portion layer of water resistant material is made of vinyl plastics.

* * * * *